US011432622B2

(12) United States Patent
Owings et al.

(10) Patent No.: US 11,432,622 B2
(45) Date of Patent: Sep. 6, 2022

(54) RELEASABLE COUPLING DEVICE

(71) Applicant: NIKE, Inc., Beaverton, OR (US)

(72) Inventors: Andrew A. Owings, Portland, OR (US); Nicholas Buck, Camas, WA (US); Adam Whiton, Chestnut Hill, MA (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 17/174,655

(22) Filed: Feb. 12, 2021

(65) Prior Publication Data

US 2021/0289893 A1 Sep. 23, 2021

Related U.S. Application Data

(60) Provisional application No. 62/990,821, filed on Mar. 17, 2020.

(51) Int. Cl.
*A44B 19/38* (2006.01)
*A44B 19/06* (2006.01)

(52) U.S. Cl.
CPC ..... *A44B 19/388* (2013.01); *A44B 19/06* (2013.01)

(58) Field of Classification Search
CPC ..... A44B 19/06; A44B 19/388
See application file for complete search history.

(56) References Cited

U.S. PATENT DOCUMENTS 4,078,279 A * 3/1978 Heimberger ..... A44B 19/38 24/434
4,139,927 A * 2/1979 Heimberger ..... A44B 19/38 24/434
4,152,813 A * 5/1979 Heimberger ..... A44B 19/38 24/434
6,088,888 A * 7/2000 Oda ..... A44B 19/38 24/433
6,421,887 B1 * 7/2002 Oda ..... A44B 19/38 24/433
7,320,158 B2 * 1/2008 Deto ..... A44B 19/384 24/303
8,146,214 B2 * 4/2012 Peters ..... A44B 19/38 24/388
8,341,809 B2 1/2013 Damon et al.
(Continued)

FOREIGN PATENT DOCUMENTS

BR 112014005633 A2 3/2017
CN 102802459 B 1/2016
(Continued)

OTHER PUBLICATIONS

International Search Report and Written Opinion received for PCT Patent Application No. PCT/US2021/018193, dated Jun. 10, 2021, 13 pages.

*Primary Examiner* — Jason W San

(74) *Attorney, Agent, or Firm* — Shook, Hardy & Bacon L.L.P.

(57) ABSTRACT

Aspects herein are directed to a releasable coupling device having a first housing structure than includes a temporary magnet and a second housing structure that includes a permanent magnet. The first housing structure is receivable by a receiving receptacle of the second housing structure. The releasable coupling device may be included as part of a slide fastener assembly having two slider tapes.

9 Claims, 12 Drawing Sheets

(56) References Cited

U.S. PATENT DOCUMENTS

| | | | | |
|---|---|---|---|---|
| 8,484,764 | B2 * | 7/2013 | Damon | H01F 7/0252 2/96 |
| 8,484,811 | B2 | 7/2013 | Damon et al. | |
| 8,528,115 | B2 | 9/2013 | Damon et al. | |
| 8,813,319 | B2 * | 8/2014 | Ogura | A44B 19/26 24/434 |
| 8,959,726 | B2 | 2/2015 | Peters et al. | |
| 8,997,263 | B2 | 4/2015 | Damon et al. | |
| 9,027,210 | B2 * | 5/2015 | Peters | A44B 99/00 24/433 |
| 9,149,092 | B2 | 10/2015 | Damon et al. | |
| 10,292,461 | B2 * | 5/2019 | Jin | A44B 19/04 |
| 2003/0213106 | A1 * | 11/2003 | Ichikawa | A44B 19/388 24/433 |
| 2005/0050699 | A1 * | 3/2005 | Yoneoka | A44B 19/38 24/433 |
| 2008/0040901 | A1 * | 2/2008 | Himi | A44B 19/26 24/433 |
| 2013/0061436 | A1 * | 3/2013 | Peters | A44B 19/388 24/430 |
| 2014/0289928 | A1 * | 10/2014 | Damon | A44B 19/26 2/69 |

FOREIGN PATENT DOCUMENTS

| | | | |
|---|---|---|---|
| CN | 103917124 | B | 6/2017 |
| EP | 2442684 | A2 | 4/2012 |
| EP | 2605679 | B1 | 2/2016 |
| EP | 2755521 | B1 | 4/2018 |
| FR | 2851136 | A1 | 8/2004 |
| JP | 3170902 | U | 9/2011 |
| JP | 5319841 | B2 | 10/2013 |
| JP | 6129842 | B2 | 5/2017 |
| KR | 10-1835175 | B1 | 3/2018 |
| WO | 2010/147906 | A2 | 12/2010 |

* cited by examiner

RELEASABLE COUPLING DEVICE

CROSS-REFERENCE TO RELATED APPLICATIONS

This application, entitled "Releasable Coupling Device," claims the benefit of priority of U.S. Provisional Application Number 62/990,821, filed on Mar. 17, 2020, and entitled "Releasable Coupling Device." The entirety of the aforementioned application is incorporated by reference herein.

TECHNICAL FIELD

Aspects herein are directed to a releasable coupling device including a first housing structure with a temporary magnet that is receivable by a second housing structure with a permanent magnet.

BACKGROUND

By way of background, slide fastener assemblies may include a slide fastener and two sets of coupling elements, such as rails or zipper teeth that are coupled or decoupled when the slide fastener traverses coupling elements of both sets. To perform this function, the slide fastener is required to be mounted on both sets of coupling elements. Some types of slide fasteners assemblies, such as those that may be completely unfastened, include a slide fastener that is permanently mounted to one set of coupling elements and manually mounted to or demounted from the other set of coupling elements by a user.

In some instances, manually mounting a slide fastener to a set of coupling elements may be difficult as it requires a user to grip and move both the slide fastener and the set of coupling elements. For instance, the user may be required to steadily hold the slide fastener and a first set of coupling elements to which the slide fastener is permanently mounted while simultaneously guiding an end of a second set of coupling elements into a throat of the slide fastener. These manual operations usually involve both of the user's hands and can be challenging to perform, especially for those with limited hand mobility.

SUMMARY

The following clauses represent example aspects of concepts contemplated herein. Any one of the following clauses may be combined in a multiple dependent manner to depend from one or more other clauses. Further, any combination of dependent clauses (clauses that explicitly depend from a previous clause) may be combined while staying within the scope of aspects contemplated herein. The following clauses are examples and are not limiting.

Clause 1. A releasable coupling device for a slide fastener assembly, the releasable coupling device comprising: a first housing structure comprising a temporary magnet having a spherical shape, the first housing structure including an encircling structure that encircles a portion of the temporary magnet such that a first surface of the temporary magnet is exposed; and a second housing structure comprising a permanent magnet, the second housing structure including a receiving receptacle adapted to receive the first housing structure such that the permanent magnet is in near contact with the first surface of the temporary magnet.

Clause 2. The releasable coupling device according to clause 1, wherein the temporary magnet if formed of a material that includes at least one of iron, steel, carbon, aluminum, nickel, cobalt, manganese, or silicon.

Clause 3. The releasable coupling device according to any of clauses 1 through 2, wherein the first housing structure further comprises a flange extending from the encircling structure, and wherein the second housing structure comprises a notch that is adapted to receive the flange of the first housing structure.

Clause 4. The releasable coupling device according to any of clauses 1 through 3, wherein, when the first housing structure and the second housing structure are within a coupling distance, the temporary magnet and the permanent magnet are magnetically attracted.

Clause 5. The releasable coupling device according to clause 4, wherein, when the first housing structure and the second housing structure are separated by a distance that is greater than the coupling distance, the temporary magnet and the permanent magnet are not magnetically attracted.

Clause 6. The releasable coupling device according to clause 5, wherein the coupling distance is from about 2.5 cm to about 3.5 cm.

Clause 7. The releasable coupling device according to any of clauses 1 through 6, wherein the permanent magnet includes a planar first surface, and wherein a portion of the planar first surface is exposed in the second housing structure.

Clause 8. The releasable coupling device according to clause 7 wherein, when the first housing structure is received by the receiving receptacle of the second housing structure, the exposed portion of the planar first surface of the permanent magnet is in near contact with the first surface of the temporary magnet, Clause 9. The releasable coupling device according to clause 7, wherein the permanent magnet includes a planar second surface that is positioned opposite the planar first surface, and wherein at least a portion of the planar second surface is exposed in the second housing structure.

Clause 10. The releasable coupling device according to clause 9, wherein the exposed portion of the planar second surface of the permanent magnet has a greater surface area than the exposed portion of the planar first surface of the permanent magnet.

Clause 11. A slide fastener assembly comprising: a first slider tape having a first set of coupling elements; a second slider tape having a second set of coupling elements; a first housing structure of a releasable coupling device attached to the first slider tape, the first housing structure comprising a temporary magnet having a spherical shape, the first housing structure including an encircling structure that encircles a portion of the temporary magnet such that a first surface of the temporary magnet is exposed; and a second housing structure of the releasable coupling device attached to the second slider tape, the second housing structure comprising a permanent magnet, the second housing structure including a receiving receptacle adapted to receive the first housing structure such that the permanent magnet is in near contact with the first surface of the temporary magnet.

Clause 12. The slide fastener assembly according to clause 11, wherein, when the first housing structure and the second housing structure are within a coupling distance, the temporary magnet and the permanent magnet are magnetically attracted.

Clause 13. The slide fastener assembly according to any of clauses 11 through 12, wherein the temporary magnet includes a second surface that is positioned opposite the first surface of the temporary magnet and is exposed in the first housing structure.

Clause 14. The slide fastener assembly according to any of clauses 11 through 13, wherein the permanent magnet includes a planar first surface, and wherein at least a portion of the planar first surface is exposed in the second housing structure.

Clause 15. The slide fastener assembly according to clause 14, wherein, when the first housing structure is received by the receiving receptacle of the second housing structure, the exposed portion of the planar first surface of the permanent magnet is in near contact with the first surface of the temporary magnet.

Clause 16. The slide fastener assembly according to any of clauses 11 through 15, wherein the first housing structure further comprises a first extension member extending in a first direction away from the encircling structure, and wherein the first extension member is attached to a first end of the first slider tape.

Clause 17. The slide fastener assembly according to clause 16, wherein the second housing structure further comprises a second extension member extending in a second first direction away from the receiving receptacle, and wherein the second extension member is attached to a second end of the second slider tape.

Clause 18. A method of manufacturing a releasable coupling device, the method comprising: positioning a temporary magnet having a spherical shape in a first housing structure that includes an encircling structure that encircles a portion of the temporary magnet such that a first surface of the temporary magnet is exposed; and positioning a permanent magnet in a second housing structure that includes a receiving receptacle adapted to receive the first housing structure such that the permanent magnet is in near contact with the first surface of the temporary magnet.

Clause 19. The method of manufacturing a releasable coupling device according to clause 18, wherein the first housing structure further comprises a flange extending from the encircling structure, and wherein the second housing structure comprises a notch that is adapted to receive the flange of the first housing structure.

Clause 20. The method of manufacturing a releasable coupling device according to any of clauses 18 through 19, wherein the first housing structure further comprises a first extension member extending in a first direction away from the encircling structure, and wherein the second housing structure further comprises a second extension member extending in a second direction away from the receiving receptacle.

BRIEF DESCRIPTION OF THE DRAWINGS

Examples of aspects herein are described in detail below with reference to the attached drawing figures, wherein.

DETAILED DESCRIPTION

Figure 1A:
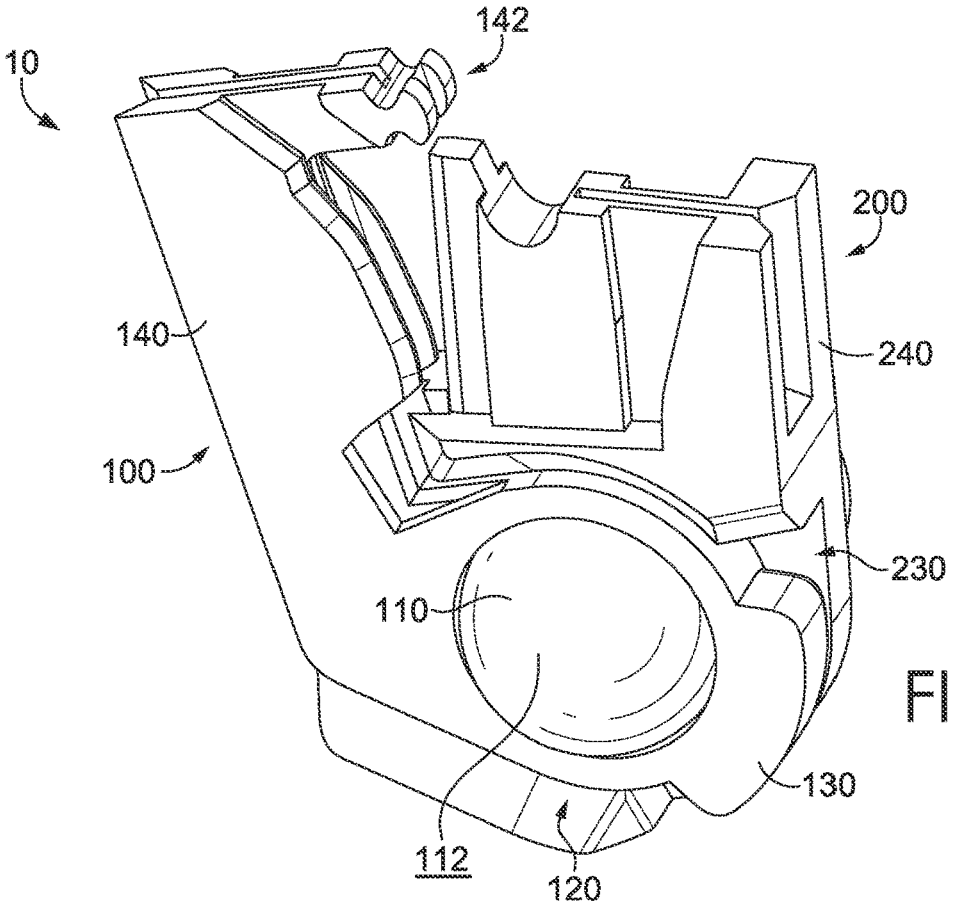
FIG. 1A illustrates a perspective view of front side of an example releasable coupling device having a first housing structure and a second housing structure receiving the first housing structure in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

Slide fastener assemblies are used to releasably fasten two sets of coupling elements and may be incorporated into releasable fastening systems of articles of apparel. Such releasable fastening systems may be used in articles to releasably fasten two portions to one another and/or may be utilized in connection with various features and aspects of articles including, but not limited to, pockets, vents, collars, sleeves, openings (e.g., arm, pant leg, torso, neck or waist), donning, removal, comfort, fit, securement, and the like. In some cases, releasable fastening systems are fully releasable such that two portions of the article can be completely separated from one another, which, for instance, allows for easier donning and doffing of the article. Such releasable fastening systems typically include slide fastener assemblies with a slide fastener that is permanently mounted to, for example, a first set of coupling elements and is removably mounted (i.e., may be mounted and demounted) to a second set of coupling elements. However, mounting and demounting the slide fastener often requires manual operations to be performed by a user, which may involve gripping and positioning or aligning the slide fastener and the two sets of coupling elements. These manual operations are more easily performed by both of a user's hands but may nevertheless be challenging, especially when performed by a user that has limited mobility in his or her hands or arms.

Aspects herein provide a releasable coupling device for a slide fastener assembly that is configured to modify manual operations related to mounting a slide fastener to a set of coupling elements in a manner that is more easily performed by a user, which may include children, people with a handicap or disability, and/or users with limited mobility in, for instance, their hands or arms. At a high level, the releasable coupling device includes a first housing structure having a temporary magnet and a second housing structure having a permanent magnet. The first and second housing structures are configured to be releasably coupled such that the first and second housing structures may be coupled when positioned within a coupling distance (e.g., moving the first and second housing structures toward one another) and may be uncoupled when repositioned beyond the coupling distance (e.g., moving the first and second housing structures away from one another to a position in which the first and second housing structures are separated by a distance greater than the coupling distance). In one aspect, the temporary magnet is configured to be demagnetized at a distance that is greater than the coupling distance, which may afford functional advantages to an article of apparel that includes the releasable coupling device. For example, use of the temporary magnet may prevent inadvertent coupling of the first and second housing structures when a wearer desires to maintain the article of apparel in an open state.

Other aspects herein provide that the first and second housing structures are configured such that the releasable coupling device may be incorporated with a slide fastener assembly including two slider tapes, each of which have a set of coupling elements. In such aspects, the first housing structure is attached to a first slider tape that includes a first set of coupling elements and the second housing structure is attached to a second slider tape that includes a second set of coupling elements. Because of these attachments, the first and second slider tapes and in turn, the first and second sets of coupling elements are adjacently positioned when the first and second housing structures are coupled.

Further aspects herein provide a method for manufacturing a releasable coupling device. In these aspects, the method may include a first step of positioning a temporary magnet having a spherical shape in a first housing structure that includes an encircling structure that encircles a portion of the temporary magnet such that a first surface of the temporary magnet is exposed. The method may further include a second step of positioning a permanent magnet in a second housing structure that includes a receiving receptacle adapted to receive the first housing structure such that the permanent magnet is in near contact with the first surface of the temporary magnet.

Aspects herein also contemplate that the temporary magnet is configured to temporarily exhibit magnetic properties. Such aspects contemplate that magnetic properties of the temporary magnet may be afforded by respective features of the temporary magnet (e.g., size, shape, material composition, or combinations thereof) and/or external conditions (e.g., exposure to a magnetic field, enclosure by a housing, or combinations thereof). In example aspects, the temporary magnet has a spherical shape and includes at least one material that becomes magnetized when exposed to a magnetic field and becomes demagnetized when no longer exposed to the magnetic field. Materials that may be included in and/or used to at least partially form the temporary magnet include but are not limited to iron, steel, carbon, aluminum, nickel, cobalt, manganese, silicon, or combinations thereof. In an example aspect, the temporary magnet may be formed of carbon steel.

Other aspects herein contemplate that the permanent magnet is configured to permanently exhibit magnetic properties. These aspects contemplate that magnetic properties of the permanent magnet may be afforded by respective features of the temporary magnet (e.g., size, shape, material composition, or combinations thereof) and may be altered or modified by external conditions, such as a manner in which the permanent magnet is enclosed by a housing. In example aspects, the permanent magnet has a cylindroid shape with one or more planar surfaces and includes at least one material that is magnetized and has a constant magnetic field. Examples of materials that may be included in and/or used to at least partially form the permanent magnet include but are not limited to neodymium alloy, iron, boron, or combinations thereof. Related aspects contemplate that the permanent magnet may be a "neodymium magnet," which may also be referred to as a "rare earth magnet."

Further aspects herein contemplate that a coupling and uncoupling of the first and second housing structures is, at least in part, attributable to the temporary magnet, the permanent magnets, and features thereof. Such aspects contemplate that the temporary magnet becomes magnetized and magnetically attracted to the permanent magnet when the temporary magnet is within a magnetic field of the permanent magnet and further contemplate that the temporary magnet becomes demagnetized and not magnetically attracted to the permanent magnet when the temporary magnet is beyond the magnetic field of the permanent magnet. In example aspects, a magnetic attraction between the temporary magnet and permanent magnet may guide a coupling of the first and second housing structures.

Unlike magnetic attractions between two permanent magnets that easily self-center due to their strong magnetic fields, it has traditionally been a challenge to self-center a magnetic attraction between a temporary magnet and a permanent magnet. In part, this is due to the temporary magnet exhibiting a weak magnetic field when brought into close proximity with the permanent magnet. Aspects herein provide that the temporary magnet and the permanent magnet are configured to magnetically attract in a self-centering manner, or stated another way, when the temporary magnet and the permanent magnet are magnetically attracted, the temporary magnet and the permanent magnet are concentrically aligned. In an example aspect, the temporary magnet has a spherical shape that is concentric with a cylindrical shape of the permanent magnet when the temporary magnet is magnetically attracted to the permeant magnet. Staying with this example aspect, the concentric alignment of the spherical shape of the temporary magnet with the cylindrical shape of the permanent magnet, at least in part, aids in and/or guides a coupling of the first housing structure with the second housing structure when the temporary magnet is magnetically attracted to the permanent magnet.

As used herein, the term "article of apparel" encompasses any number of products meant to be worn by a user including upper-body garments (e.g., shirts, jackets, hoodies, pullovers), lower-body garments (e.g., pants, shorts, leggings), articles of footwear such as shoes or socks, articles of headwear (e.g., hats), gloves, sleeves (e.g., arm sleeves, calf sleeves), and the like. Positional terms used when describing the article of apparel such as front, back, inner-facing surface, outer-facing surface, upper, lower, proximal, distal, medial, lateral, and the like are with respect to the article of apparel being worn as intended with the user standing upright.

Figure 5B:
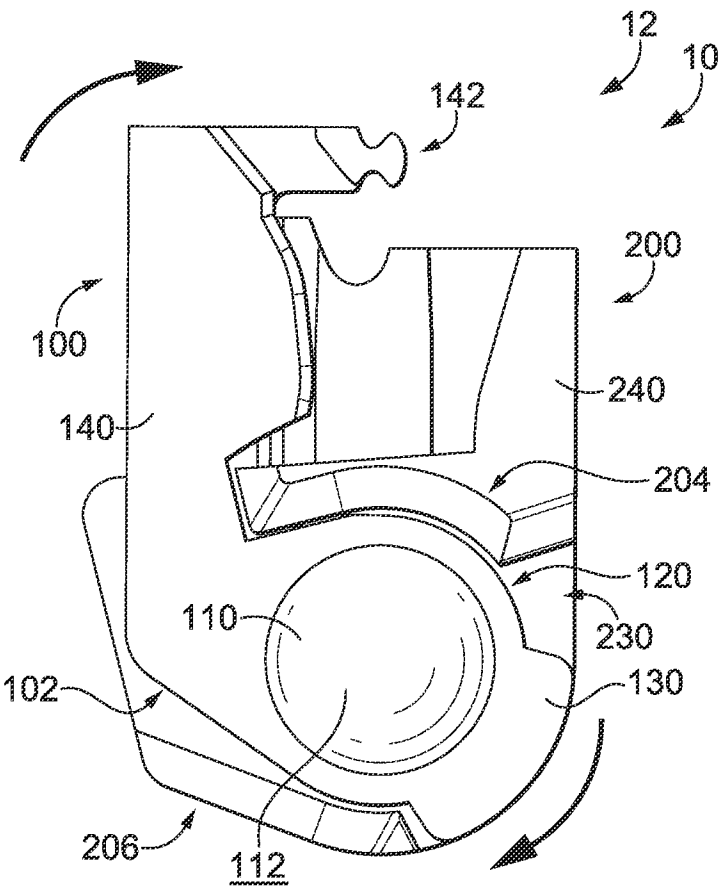
FIG. 5B illustrates a front view of the releasable coupling device of FIG. 1A in a second position in accordance with aspects herein.
Figure 5A:
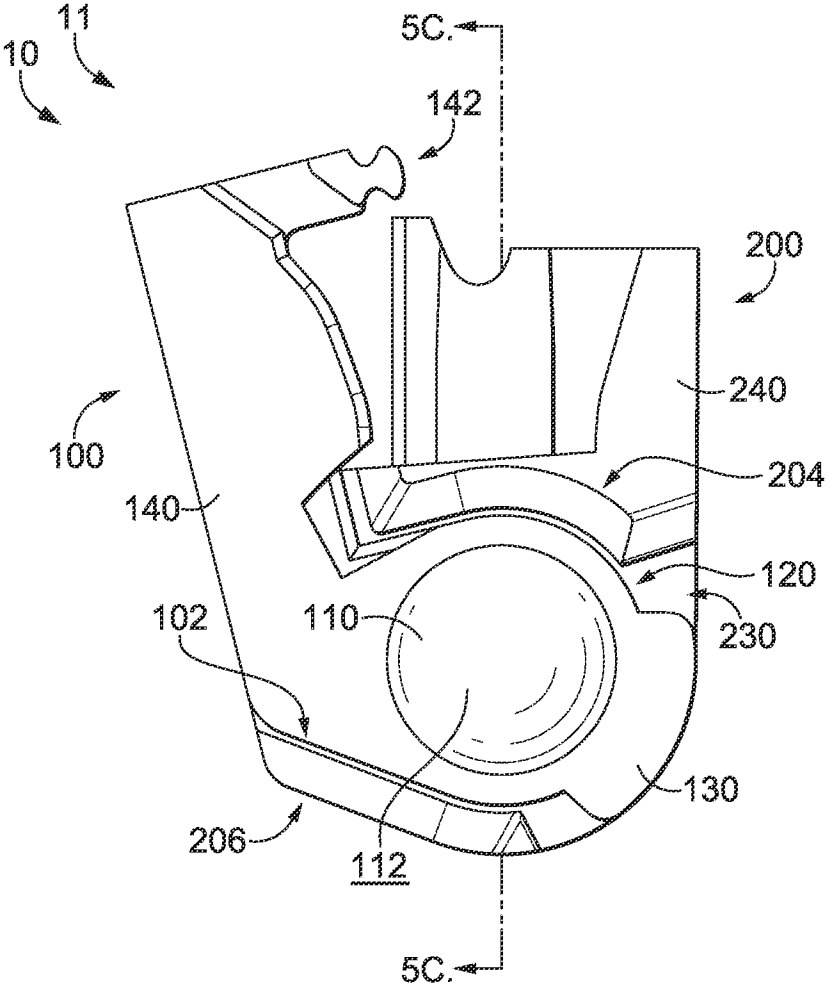
FIG. 5A illustrates a front view of the releasable coupling device of FIG. 1A in a first position in accordance with aspects herein.

In addition, positional terms used when describing the releasable coupling device such as front side, rear side, left side, right side, top, bottom, lower, upper, lower most, uppermost, inferior, superior, frontward, rearward, and the like are with respect to the releasable coupling device positioned on a flat vertical plane, parallel to a y-axis with the first housing structure poisoned more leftward than the second housing structure when viewing the releasable coupling device (e.g., the releasable coupling device as depicted in FIG. 5A). Moreover, positional terms used when describing the first housing structure, the second housing structure, and aspects thereof such as front, rear, left, right, top, bottom, inferior, superior, frontward, rearward, forward, backward, and the like are with respect to the releasable coupling device positioned on a flat vertical plane, parallel to a y-axis with the first housing structure poisoned more leftward than the second housing structure (e.g., the first and second housing structures as depicted individually in FIGS. 2B and 3B, respectively and as depicted in the releasable coupling device in FIG. 5A).

As used herein, terms describing surfaces and/or portions thereof of the temporary magnet and/or the permanent magnet such as exposed, encircled, enclosed, covered, uncovered, and the like are with respect to the first housing structure and the second housing structure isolated from one another. For example, the term "exposed portion" when used to describe a surface of the temporary magnet refers to an area of the surface that forms an outermost exterior portion of the first housing structure when the first and second housing structures are uncoupled.

Figure 1B:
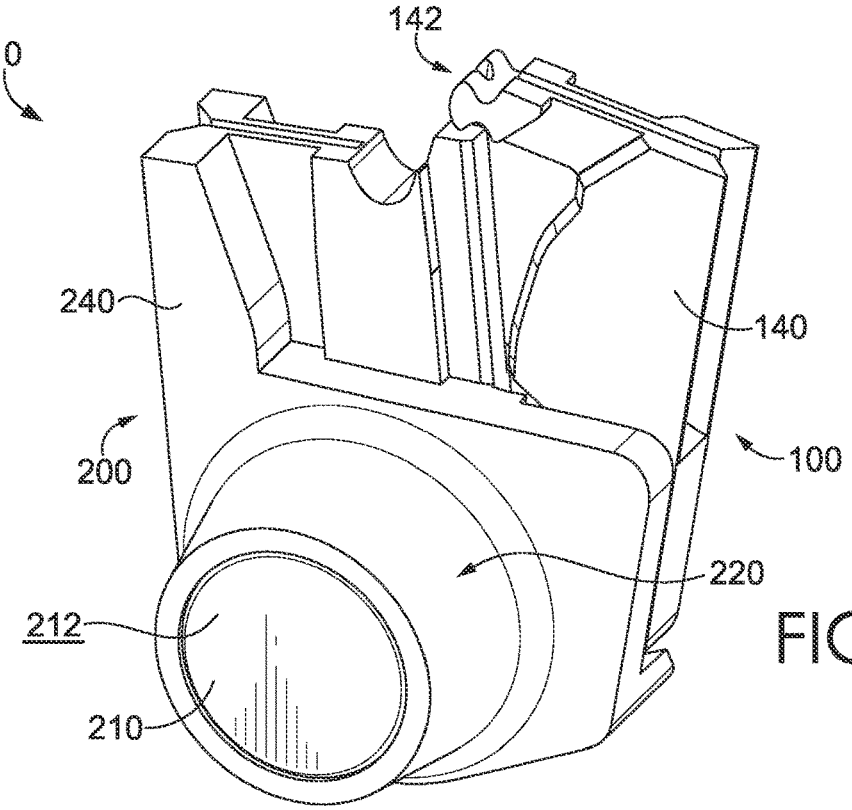
FIG. 1B illustrates a perspective view of a rear side of the releasable coupling device of FIG. 1A in accordance with aspects herein.

FIGS. 1A and 1B respectively illustrate perspective views of a front side and a rear side of an example releasable coupling device 10 for a slide fastener assembly. As shown, the releasable coupling device 10 includes a first housing structure 100 and a second housing structure 200. In FIGs. 1A and 1B, the releasable coupling device 10 is depicted with the second housing structure 200 receiving the first housing structure 100, or stated another way, the first and second housing structures 100, 200 are depicted as coupled. When coupled, the first and second housing structures 100, 200 are in contact and positioned such that the first housing structure 100 is partially in front of a portion of the second housing structure 200 in the releasable coupling device 10. Thus, at areas where the first and second housing structures 100, 200 overlap in the releasable coupling device 10, at least a portion of the second housing structure 200 is hidden from view by the first housing structure 100 in FIG. 1A, and likewise, at least a portion of the first housing structure 100 is hidden from view by the second housing structure 200 in FIG. 1B. In example aspects, the first and second housing structures 100, 200 may be constructed using three-dimensional printing techniques using materials such as polyamides, which include, but are not limited to nylon 12. Other aspects contemplate that a variety of injection moldable plastics may also be used to construct the first and second housing structures 100, 200.

The temporary magnet 110 is depicted as having a spherical shape and as being included in the first housing structure 100 in a manner such that portions of the temporary magnet 110 are exposed and other portions are covered by the first housing structure 100. Although not depicted, aspects contemplate that the temporary magnet 110 may have other three dimensional shapes including, but not limited to a cone, cylinder, cuboid, pyramid, prism, and the like. The permanent magnet 210 is depicted as having a shape that includes one or more planar surfaces and as being included in the second housing structure 200 in a manner such that portions of the permanent magnet 210 are exposed and other portions are covered by the second housing structure 200. Aspects contemplate that the permanent magnet 210 may have a variety of three dimensional shapes including but not limited to a sphere, cone, cylinder, cuboid, pyramid, prism, and the like.

In aspects, the first and second housing structures 100, 200 include features that individually and cooperatively contribute to properties and characteristics of the releasable coupling device 10. Such aspects include complimentary and/or interconnected features of the first and second housing structures 100, 200 that, in combination, afford coupling and decoupling characteristics to the releasable coupling device 10. The relationships among these features are more easily explained and better appreciated with an independent understanding of the first and second housing structures 100, 200. Thus, the first housing structure 100 and the second housing structure 200 are discussed individually below.

Beginning with the first housing structure 100, as can be seen in FIG. 1A, the first housing structure 100 comprises a temporary magnet 110, an encircling structure 120, a flange 130, and a first extension member 140. In this example, the first housing structure 100 is generally shaped like an "L" in which the temporary magnet 110, the encircling structure 120, and the flange 130 collectively form a lower, horizontal portion of the first housing structure 100, and the first extension member 140 extends away from the lower, horizontal portion and forms an upper, vertical portion of the first housing structure 100. The flange 130 extends from the encircling structure 120 in a direction away from the first extension member 140, and as discussed below in more detail, the flange 130 is configured to align the first and second housing structures 100, 200 before and during coupling. The first extension member 140 extends away from the encircling structure 120 in a first direction (not identified) and is configured to incorporate the releasable coupling device 10 into a slide fastener assembly. Moreover, at an upper most portion of the first extension member 140, the first extension member 140 includes an optional zipper tooth 142 that is configured to couple with opposing zipper teeth when the releasable coupling device 10 is included in a slide fastener assembly. In aspects, the zipper tooth 142 may be excluded or replaced by a different type of coupling element, which, for example, may correspond to coupling elements of a slider tape included in a slide fastener assembly.

Figure 2C:
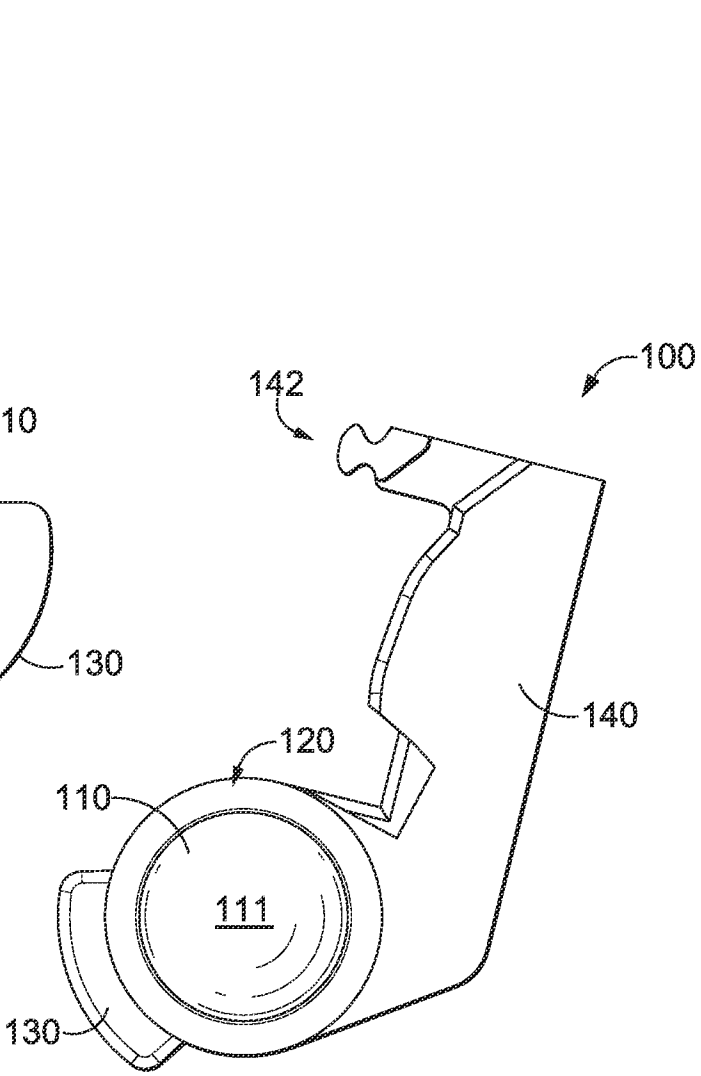
FIG. 2C illustrates a rear view of the first housing structure of the releasable coupling device of FIG. 1A in accordance with aspects herein.
Figure 2B:
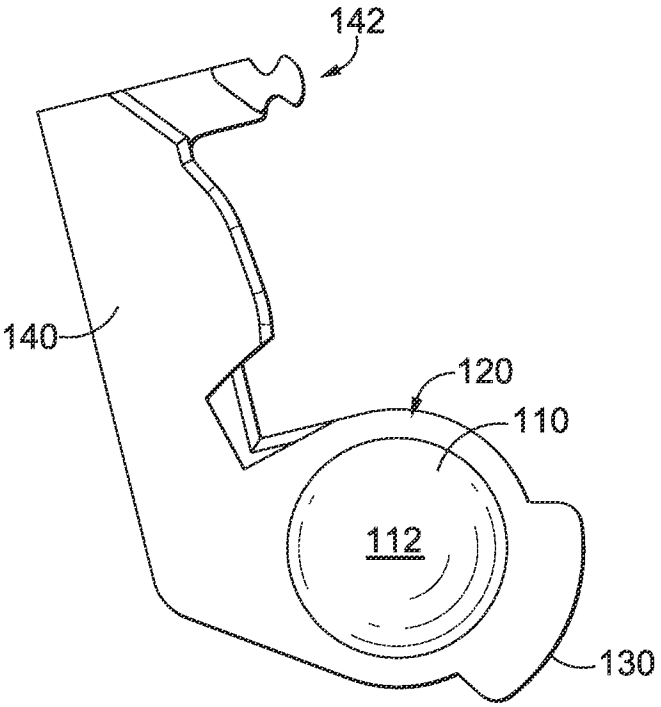
FIG. 2B illustrates a front view of the first housing structure of the releasable coupling device of FIG. 1A in accordance with aspects herein.
Figure 2A:
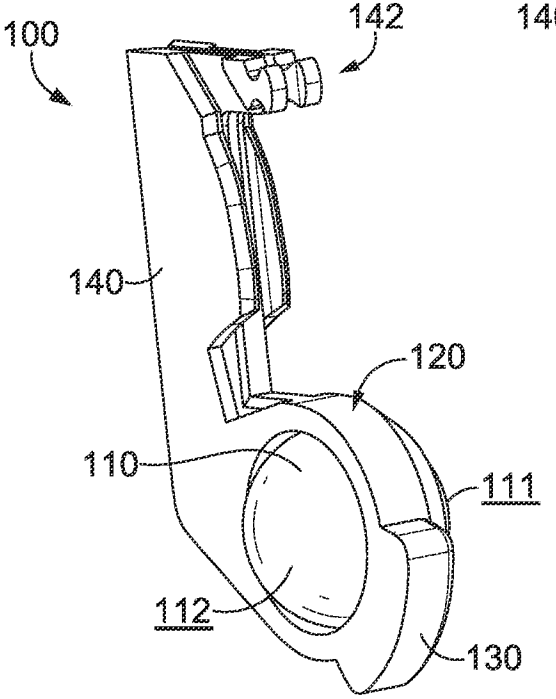
FIG. 2A illustrates a perspective view of a front side of the first housing structure of the releasable coupling device of FIG. 1A in accordance with aspects herein.

FIGS. 2A-2C respectively illustrate a perspective view, a front view, and a rear view of the first housing structure 100 isolated from the second housing structure 200. At a high level, the first housing structure 100 is configured to retain the temporary magnet 110 such that the encircling structure 120 encircles a portion of the temporary magnet 110. As shown, the temporary magnet 110 is a sphere and therefore, has a rounded exterior surface, which includes at least one portion that is encircled by the encircling structure 120 and at least two other portions that are exposed in the first housing structure 100. As such, the temporary magnet 110 has a first surface 111 that is exposed on the rear side of the first housing structure 100 (e.g., FIG. 2C) and a second surface 112 that is exposed on the front side of the first housing structure 100 (e.g., FIG. 2B). Both the first surface 111 and the second surface 112 are rounded on account of a spherical shape of the temporary magnet 110, and in related aspects, the first surface 111 and the second surface 112 each have a respective surface area which may be the same or different.

The encircling structure 120 is configured to retain the temporary magnet 110 such that the encircling structure 120 generally surrounds an entire circumference of the temporary magnet 110 in the first housing structure 100. In FIGS. 1A and 2A-2C, the encircling structure 120 is circularly shaped and forms a perimeter around a circumference of the temporary magnet 110. The encircling structure 120 extends parallel to a vertical plane, and as such, is parallel to a surface plane of the first housing structure 100. In some example aspects, the encircling structure 120 extends along the same surface plane as the first housing structure 100. Further, the encircling structure 120 encircles a portion of the temporary magnet 110 such that the first and second surfaces 111, 112 are exposed in the first housing structure 100. In one example aspect, the encircling structure 120, extends around a meridian of the temporary magnet 110 and separates the temporary magnet 110 into two hemispheres, which are generally positioned on opposing sides of the first housing structure 100. In another example aspect, the encircling structure 120 may be positioned to separate the temporary magnet 110 into two unequal halves. In other aspects, the encircling structure 120 may encircle the temporary magnet 110 such that more surface area of the temporary magnet 110 is enclosed by the encircling structure 120 on the rear side of the first housing structure 100 than the front side, or vice versa. Such aspects contemplate that the temporary magnet 110 may be partially inset within the encircling structure 120 on the front side of the first housing structure 100. One example aspect contemplates that the encircling structure 120 may be sized such that the encircling structure 120 tightly extends around a circumference of the temporary magnet 110 in a manner that holds the temporary magnet 110 in place via frictional forces.

Regarding the second housing structure 200, in FIGS. 1A and 1B, the second housing structure 200 comprises a permanent magnet 210, a receiving receptacle 220, a notch 230, and a second extension member 240. The second housing structure 200 is generally shaped like a backwards "L" such as shown in FIG. 3B in which the permanent magnet 210, the receiving receptacle 220, and the notch 230 collectively form a lower, horizontal portion and the second extension member 240 extends away from the lower, horizontal portion and forms an upper, vertical portion. The notch 230 extends from the receiving receptacle 220 and is positioned inferior to and on the same side of the second housing structure 200 as the second extension member 240. The notch 230 is adapted to receive the flange 130 of the first housing structure 100. The second extension member 240 extends away from the receiving receptacle 220 in a second direction (not identified) and is configured to incorporate the releasable coupling device 10 into a slide fastener assembly.

Figure 3C:
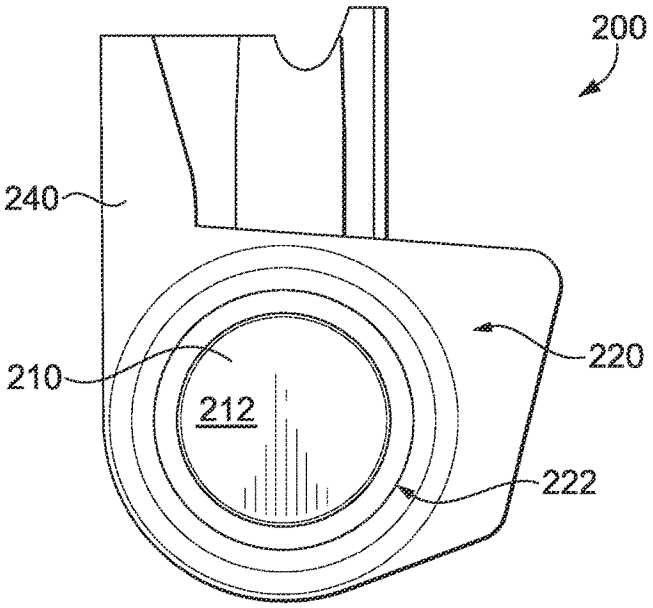
FIG. 3C illustrates a rear view of the second housing structure of the releasable coupling device of FIG. 1A in accordance with aspects herein.
Figure 3B:
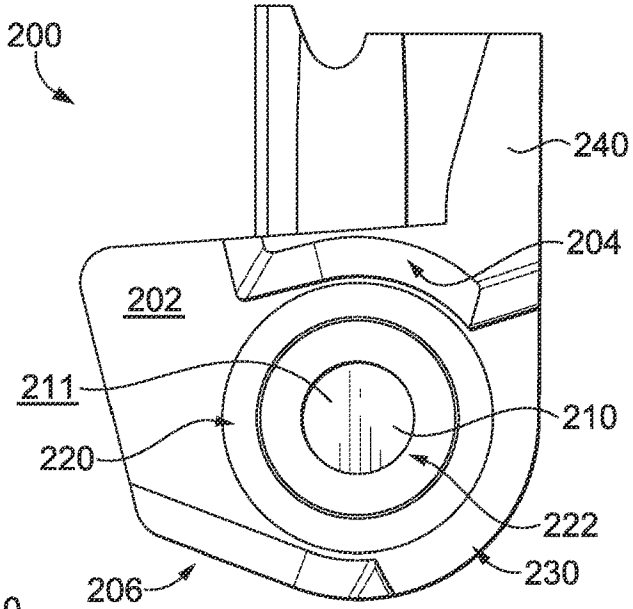
FIG. 3B illustrates a front view of the second housing structure of the releasable coupling device of FIG. 1A in accordance with aspects herein.
Figure 3A:
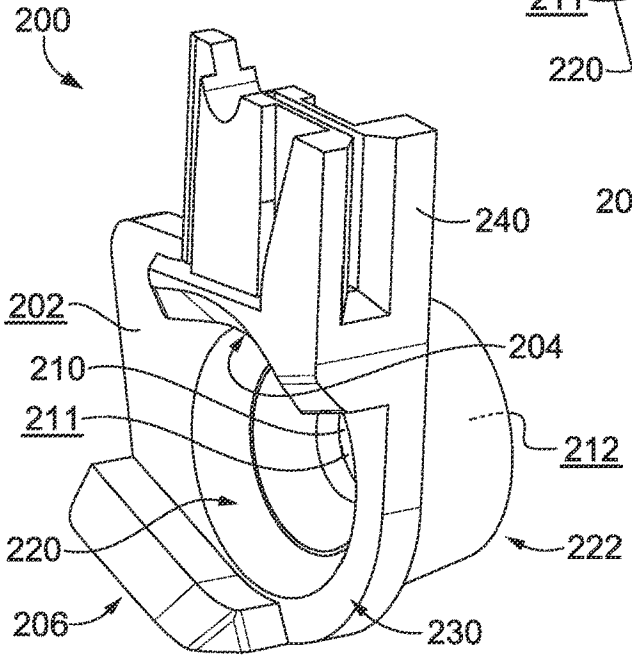
FIG. 3A illustrates a perspective view of a front side of the second housing structure of the releasable coupling device of FIG. 1A in accordance with aspects herein.

FIGS. 3A-3C respectively illustrate a perspective view, a front view, and a rear view of the second housing structure 200 isolated from the first housing structure 100. Generally, the second housing structure 200 is configured to retain the permanent magnet 210 and is further configured to receive the first housing structure 100. As shown, the permanent magnet 210 is positioned within the receiving receptacle 220 and has an example cylindroid shape, with two flat, circular surfaces positioned opposite one another and a curved edge extending between the surfaces. In this example aspect, the permanent magnet 210 may be a cylinder with a constant width having a diameter from about 0.5 cm to about 1.5 cm and a height (i.e., a distance between the two, flat, circular surfaces) from about 0.2 cm to about 0.5. As used herein and when referring to a size of the permanent magnet 210 the term "about" means±0.1 cm. Accordingly, the permanent magnet 210 includes a first planar surface 211 and a second planar surface 212. The first planar surface 211 includes a portion that is exposed on the front side of the second housing structure 200 (e.g., FIG. 3B), and similarly, the second planar surface 212 includes a portion that is exposed on the rear side of the second housing structure 200 (e.g., FIG. 3C). Moreover, both the first planar surface 211 and the second planar surface 212 are circular and flat on account of a shape of the permanent magnet 210, and in similar aspects, the first planar surface 211 and the second planar surface 212 each have a respective surface area that may be the same or different. In an example aspect, the permanent magnet 210 may be retained in the second housing structure 200 by press fitting.

The receiving receptacle 220 is adapted to receive the first housing structure 100 and therefore, is configured to have a general structure that is negative to a portion of the first housing structure 100 that is received by the receiving receptacle 220. Such aspects contemplate that the receiving receptacle 220 may be configured to have a size that is slightly larger than a received portion of the first housing structure 100, and in related aspects, the second housing structure 200 may include additional features that are configured or adapted to receive the first housing structure 100 and/or components thereof, and such features may be related to and/or positioned proximate the receiving receptacle 220.

FIGS. 3A and 3B depict the second housing structure 200 as including a receiving surface 202, a first projection 204, and a second projection 206, all of which are configured or adapted to receive the first housing structure 100. The first projection 204 and the second projection 206 extend outward from the receiving surface 202 and are generally positioned on opposing sides of the receiving receptacle 220 (e.g., a top side and a bottom side). Thus, the notch 230, which extends away from the receiving receptacle 220, is positioned between the first and second projections 204, 206. In one aspect, the first projection 204 defines an upper boundary of the notch 230 and the second projection 206 defines a lower boundary of the notch 230. The receiving receptacle 220 is depicted as generally forming a circular depression in the second housing structure 200 and as being surrounded by the receiving surface 202, the first projection 204, the second projection 206, and the notch 230. Moreover, in example aspects, the receiving receptacle 220 has a frustoconical shape extending from the receiving surface 202 and a rear side of the second housing structure 200. In other aspects, the receiving receptacle 220 may have a different shape including, but not limited to a hemispherical shape, cylindrical shape, cone, cuboid, pyramid, prism, and the like.

The receiving receptacle 220 also includes an enclosure structure 222 that is positioned proximate the rear side of the second housing structure 200, forms a rear most portion of the receiving receptacle 220, and is circularly shaped in example aspects. The enclosure structure 222 is configured to retain the permanent magnet 210, and in aspects, the enclosure structure 222 encloses a curved edge (not identified) of the permanent magnet 210 and may also partially enclose the first and second planar surfaces 211, 212 such that a portion of each of the first and second planar surfaces 211, 212 is exposed in the second housing structure 200. In this example, the exposed portion of the second planar surface 212 has a larger surface area than the exposed portion of the first planar surface 211. In other aspects, the enclosure structure 222 may be configured to enclose the permanent magnet 210 such that an exposed portion of the first planar surface 211 has a larger surface area than an exposed portion of the second planar surface 212. In additional aspects, the enclosure structure 222 may be configured to enclose the permanent magnet 210 such that an exposed portion of the first and second planar surfaces 211, 212 have generally equal surface areas.

FIGS. 4A-4D illustrate perspective views of the releasable coupling device 10 and depict movement of the first and second housing structures 100, 200 to and between different positions. Thus, the bracketed arrows and dashed lines between the first and second housing structures 100, 200 in FIGS. 4A, 4B, and 4D respectively represent designated distances and distances at which the first and second housing structures 100, 200 are separated from one another. Moreover, the arrows positioned next to the first and second housing structures 100, 200 in FIGS. 4B-4D indicate directional movement of the first and second housing structures 100, 200 from a position of the preceding figure (e.g., the arrows in FIG. 4B indicate movement of the first and second housing structures 100, 200 from the position of FIG. 4A in a direction towards one another).

Figure 4A:
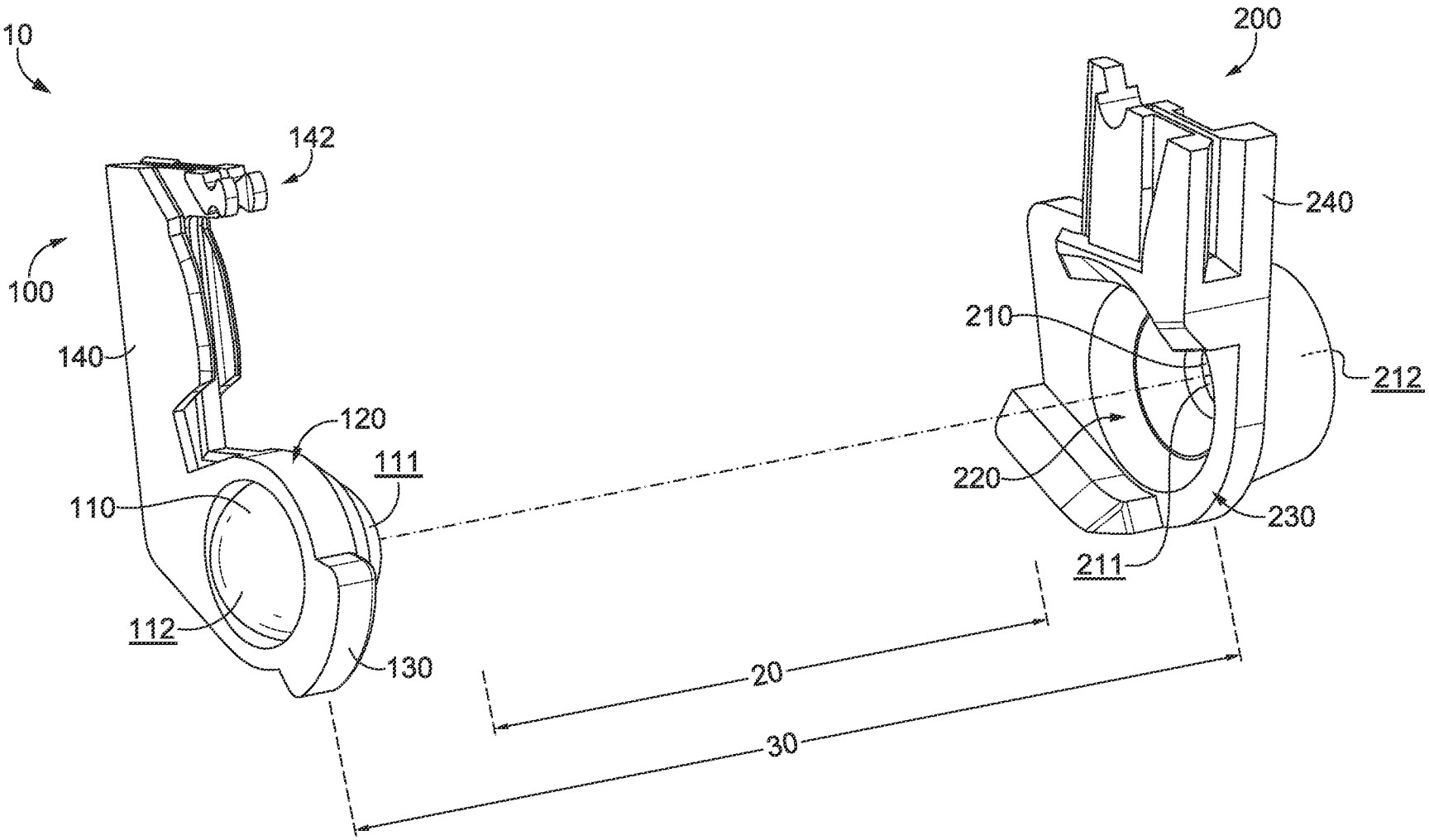
FIG. 4A illustrates a perspective view of the front side of the releasable coupling device of FIG. 1A and depicts the first and second housing structures as uncoupled and as separated from one another by a distance that is greater than a coupling distance in accordance with aspects herein.
Figure 4C:
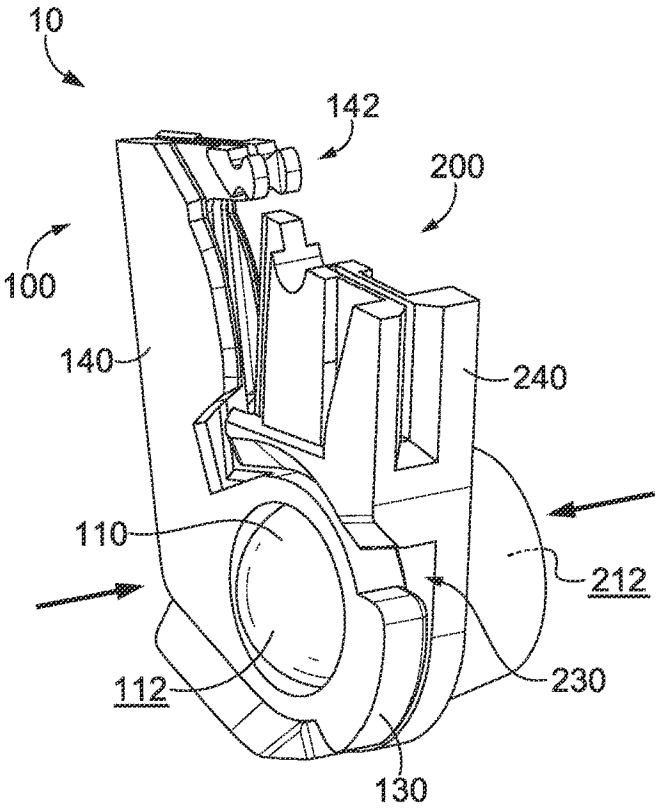
FIG. 4C illustrates a perspective view of the front side of the releasable coupling device of FIG. 1A and depicts the first and second housing structures as coupled in accordance with aspects herein.
Figure 4B:
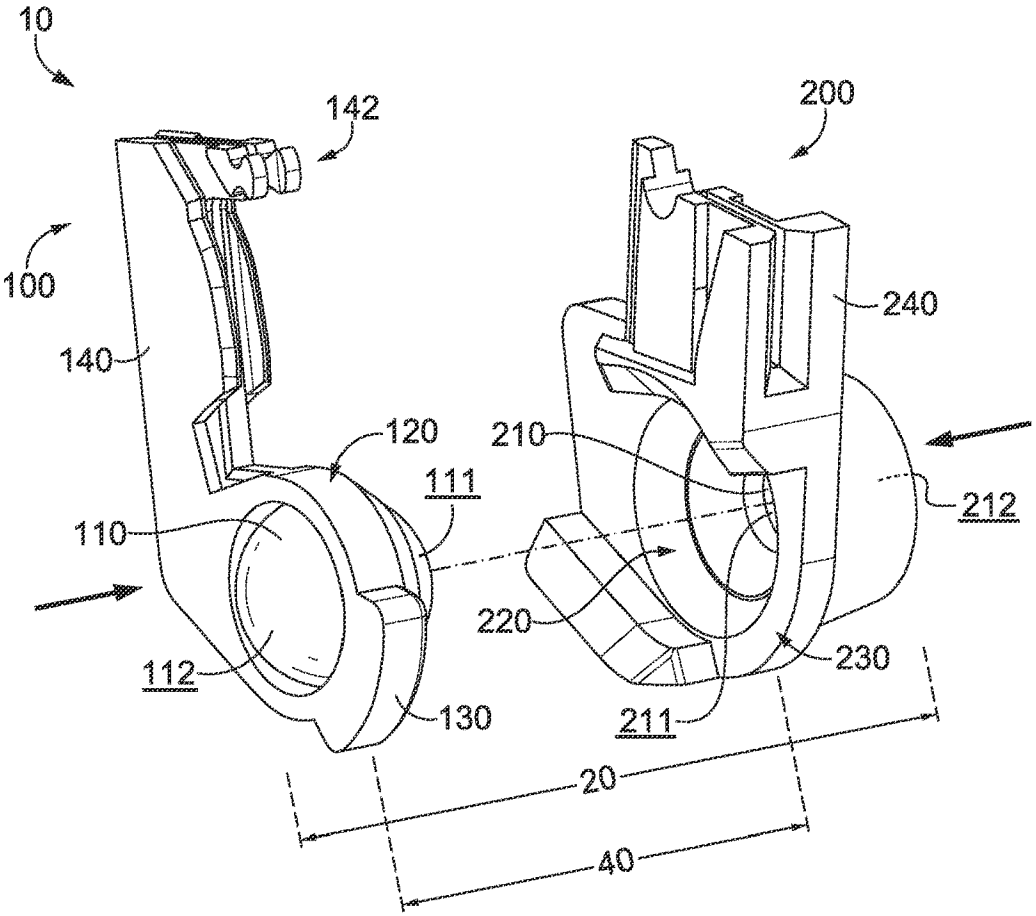
FIG. 4B illustrates a perspective view of the front side of the releasable coupling device of FIG. 1A and depicts the first and second housing structures as uncoupled and within the coupling distance in accordance with aspects herein.
Figure 4D:
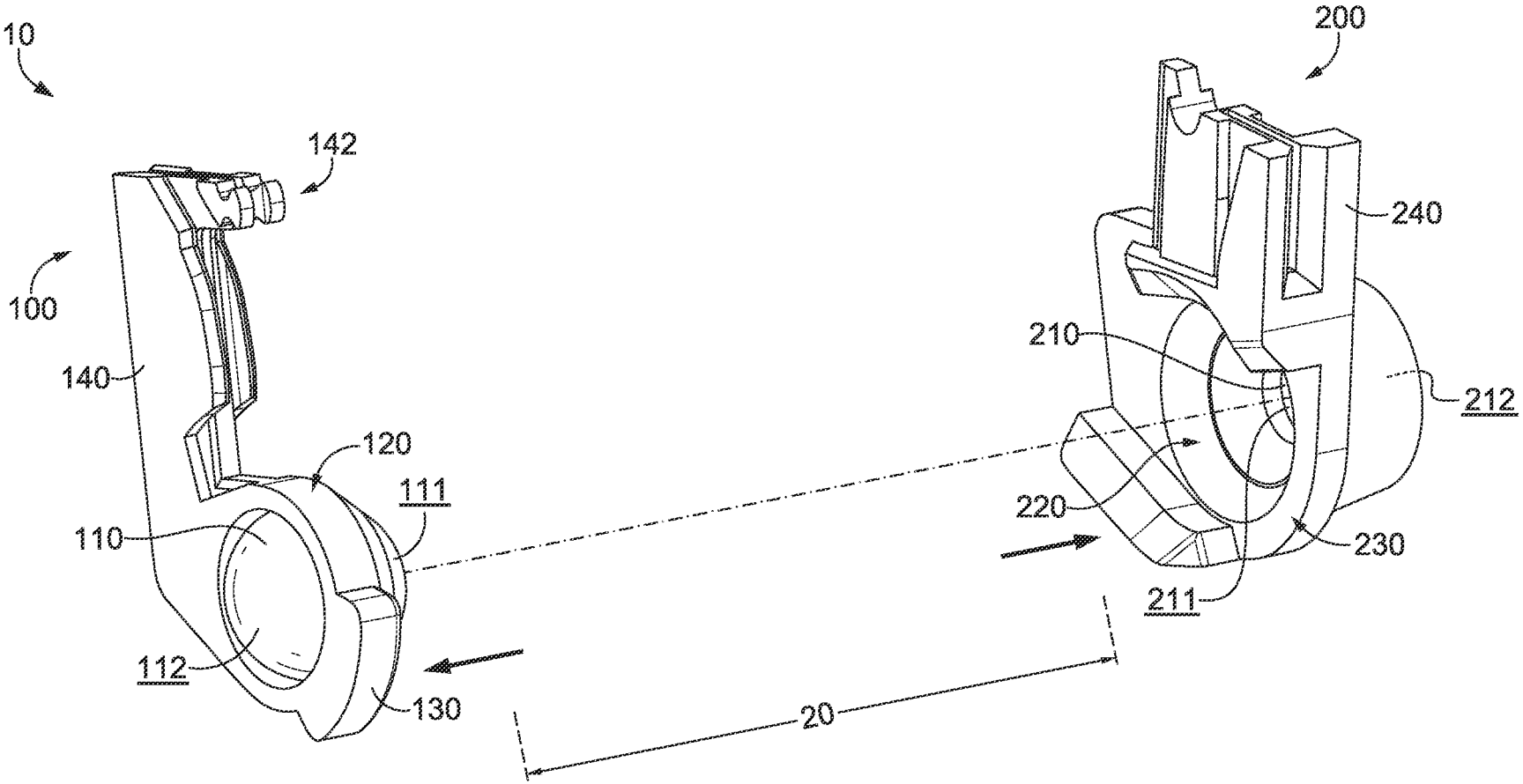
FIG. 4D illustrates a perspective view of the front side of the releasable coupling device of FIG. 1A and depicts the first and second housing structures as uncoupled and as separated from one another by a distance that is greater than the coupling distance in accordance with aspects herein.

Each of FIGS. 4A, 4B, and 4D depict a coupling distance 20, and as used herein, the term "a coupling distance" refers to a distance between the first and second housing structures 100, 200 and relates to a maximum distance at which the temporary magnet 110 is magnetized and the temporary magnet 110 and the permanent magnet 210 are magnetically attracted. In one aspect, the coupling distance may be from about 2.5 cm to about 3.5 cm. As used herein and when referring to the coupling distance, the term "about" means±0.5 cm.

FIG. 4A depicts a position in which the first and second housing structures 100, 200 are uncoupled and separated from one another by a first distance 30. As shown, the first and second housing structures 100, 200 are oriented such that the first surface 111 of the temporary magnet 110 is facing the first planar surface 211 of the permanent magnet 210. Moreover, the temporary magnet 110 and the flange 130 of the first housing structure 100 are respectively aligned with the receiving receptacle 220 and the notch 230 of the second housing structure 200. The first distance 30 is greater than the coupling distance 20, and thus, the temporary magnet 110 is not magnetized and the temporary magnet 110 and the permanent magnet 210 are not magnetically attracted when the first and second housing structures 100, 200 are separated from one another by the first distance 30. As such, in the position depicted in FIG. 4A, the first and second housing structures 100, 200 are beyond the coupling distance 20 and will remain uncoupled absent external intervention.

FIG. 4B depicts the first and second housing structures 100, 200 after being moved (e.g., by a user) from the position of FIG. 4A in a direction towards one another. Thus, FIG. 4B depicts a position in which the first and second housing structures 100, 200 are uncoupled, separated from one another by a second distance 40, and oriented in a same manner as FIG. 4A. Moreover, the second distance 40 is less than the coupling distance 20, and therefore, the temporary magnet 110 becomes magnetized, and the temporary magnet 110 and the permanent magnet 210 are magnetically attracted when the first and second housing structures 100, 200 are separated from one another by the second distance 40. As such, in the position depicted in FIG. 4B, the first and second housing structures 100, 200 are within the coupling distance 20 and will become coupled absent external intervention by a user.

FIG. 4C depicts the first and second housing structures 100, 200 after being moved (e.g., by a magnetic force and without human intervention) as being moved from the position of FIG. 4B in a direction towards one another. Therefore, FIG. 4C depicts a position in which the first and second housing structures 100, 200 are coupled, and as shown, the temporary magnet 110 and the flange 130 of the first housing structure 100 are respectively received by the receiving receptacle 220 and the notch 230 of the second housing structure 200. Since the first and second housing structures 100, 200 are within the coupling distance 20 when coupled, the temporary magnet 110 continues to be magnetized and the temporary magnet 110 and the permanent magnet 210 continue to be magnetically attracted. Accordingly, in the position depicted in FIG. 4C, the first and second housing structures 100, 200 will remain coupled absent external intervention.

FIG. 4D depicts the first and second housing structures 100, 200 after being moved (e.g., by a user) from the position of FIG. 4C in a direction away from one another and depicts a position in which the first and second housing structures 100, 200 are uncoupled and separated from one another by a distance that is greater than the coupling distance 20. The temporary magnet 110 is no longer magnetized and the temporary magnet 110 and the permanent magnet 210 are not magnetically attracted, and thus, in the position depicted in FIG. 4D, the first and second housing structures 100, 200 will remain uncoupled absent external intervention.

Figure 5C:
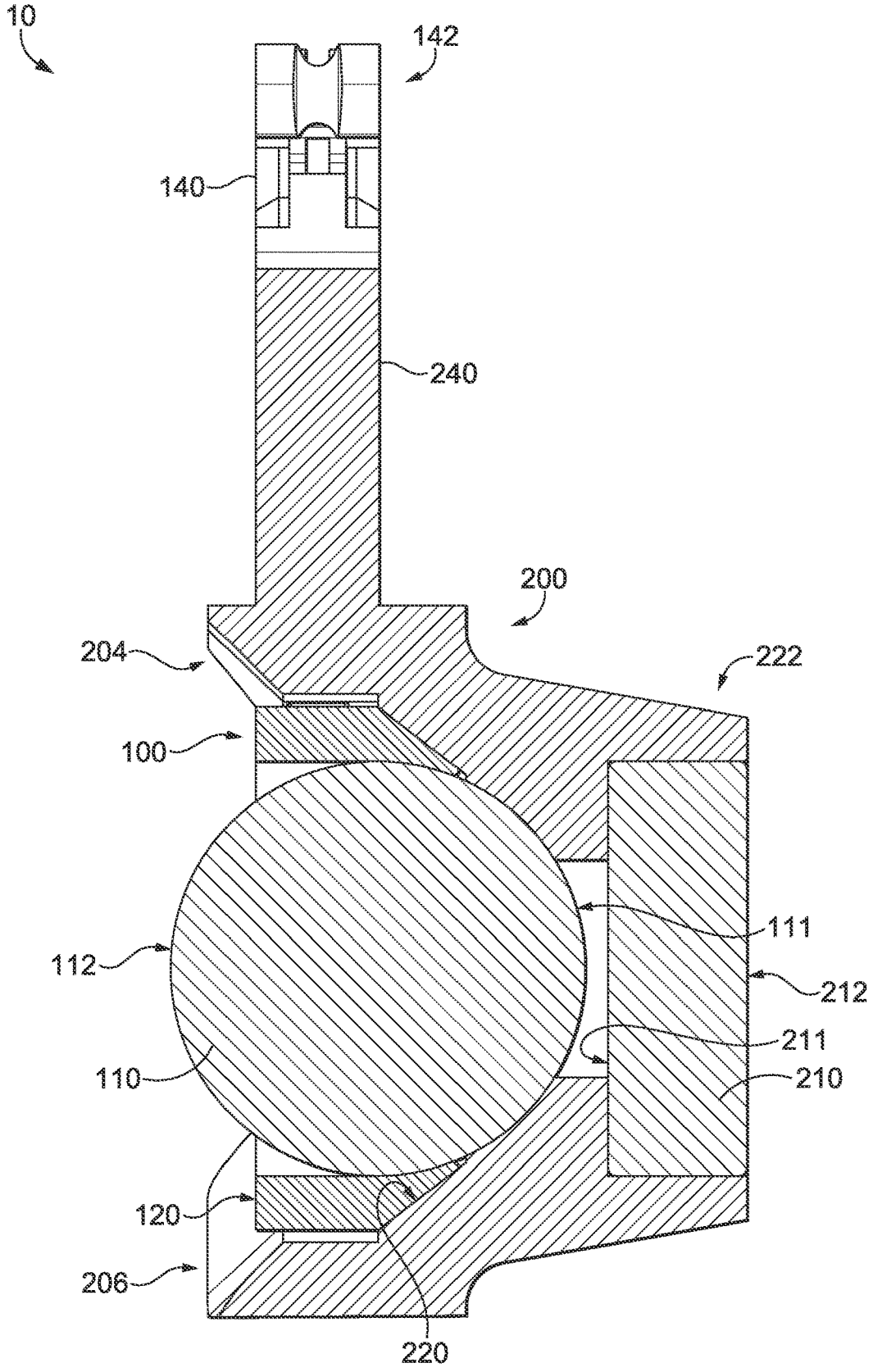
FIG. 5C illustrates a sectional view of the releasable coupling device of FIG. 1A taken along cut line 5A-5A of FIG. 5A in accordance with aspects herein.

FIGS. 5A-5C illustrate the releasable coupling device 10 when the first and second housing structures 100, 200 are coupled. FIGS. 5A and 5B respectively depict a front view of the releasable coupling device 10 in a first coupled state 11 and a second coupled state 12, and FIG. 5C is a cross-section of the releasable coupling device 10 taken along the line 5C-5C of FIG. 5A. As shown, when the first and second housing structures 100, 200 are coupled, the first housing structure 100 is received by the receiving receptacle 220 (not shown in FIGS. 5A and 5B) such that the first surface 111 of the temporary magnet 110 is proximate the first planar surface 211 of the permanent magnet 210. Moreover, the encircling structure 120 of the first housing structure 100 is positioned adjacent to the first and second projections 204, 206 of the second housing structure 200, and the flange 130 of the first housing structure 100 is received by the notch 230 of the second housing structure 200.

As shown in FIG. 5A, when the releasable coupling device 10 is in the first coupled state 11, the first extension member 140 of the first housing structure 100 is angularly offset from the second extension member 240 of the second housing structure 200. As such, the first direction (not identified), which is a direction that the first extension member 140 extends from the encircling structure 120 is non-parallel to the second direction (not identified), which is a direction the second extension member 240 extends from the receiving receptacle 220. The flange 130 is positioned centrally within the notch 230 and is spaced apart from the first and second projections 204, 206. Moreover, a bottom edge 102 of the first housing structure 100 abuts and is parallel with the second projection 206. When the releaseable coupling device 10 is in the second coupled state 12, as shown in FIG. 5B, the first and second housing structures 100, 200 are vertically aligned. As such, the first and second extension members 140, 240 and in turn, the first and second directions are also vertically aligned or are in parallel. Further, the flange 130 is positioned closer to the second projection 206 than the first projection 204 within the notch 230, and the bottom edge 102 of the first housing structure 100 is spaced apart from at least a portion of the second projection 206.

In aspects, the releasable coupling device 10 is transitionable from the first coupled state 11 to the second coupled state 12 by rotating the first housing structure 100 in a clockwise direction and/or, by rotating the second housing structure 200 in a counterclockwise direction. Similarly, the releasable coupling device 10 is transitionable from the second coupled state 12 to the first coupled state 11 by rotating the first housing structure 100 in a counterclockwise direction and/or by rotating the second housing structure 200 in a clockwise direction.

FIG. 5C depicts a cross-section of the releasable coupling device 10 taken along the line 5C-5C of FIG. 5A. As shown, when the first and second housing structures 100, 200 are coupled, the receiving receptacle 220 receives the first housing structure 100 such that the first planar surface 211 of the permanent magnet 210 is in near contact with the first surface 111 of the temporary magnet 110. As used herein, the term "in near contact" when used to describe a spatial relationship between the temporary magnet 110 and the permanent magnet 210 refers to a distance between a surface of the temporary magnet 110 and a surface of the permanent magnet 210. In example aspects, the term "in near contact" means that the first surface 111 of the temporary magnet 110 and the first planar surface 211 of the permanent magnet 210 are separated by a distance from 0.0 cm to about 0.05 cm, from about 0.01 cm to about 0.1 cm, or from about 0.06 cm to about 0.15 cm. As used herein and when referring to the term "in near contact," the term "about" means±0.05 cm.

Moreover, the encircling structure 120 is positioned between the first and second projections 204, 206, and a rearward portion of the temporary magnet 110 is received by the receiving receptacle 220. In other example aspects, the first planar surface 211 of the permanent magnet 210 is adjacent to but does not contact the first surface 111 of the temporary magnet 110.

Figure 6C:
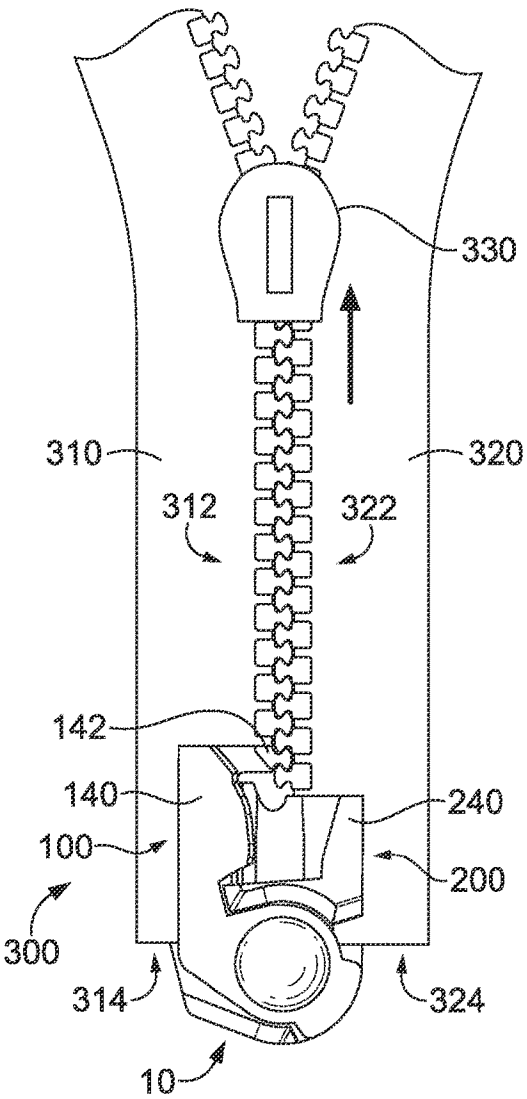
FIG. 6C illustrates a front view of the slide fastener assembly of FIG. 6A and depicts the releasable coupling device in the second position and the first and second slider tapes as being partially coupled in accordance with aspects herein.
Figure 6B:
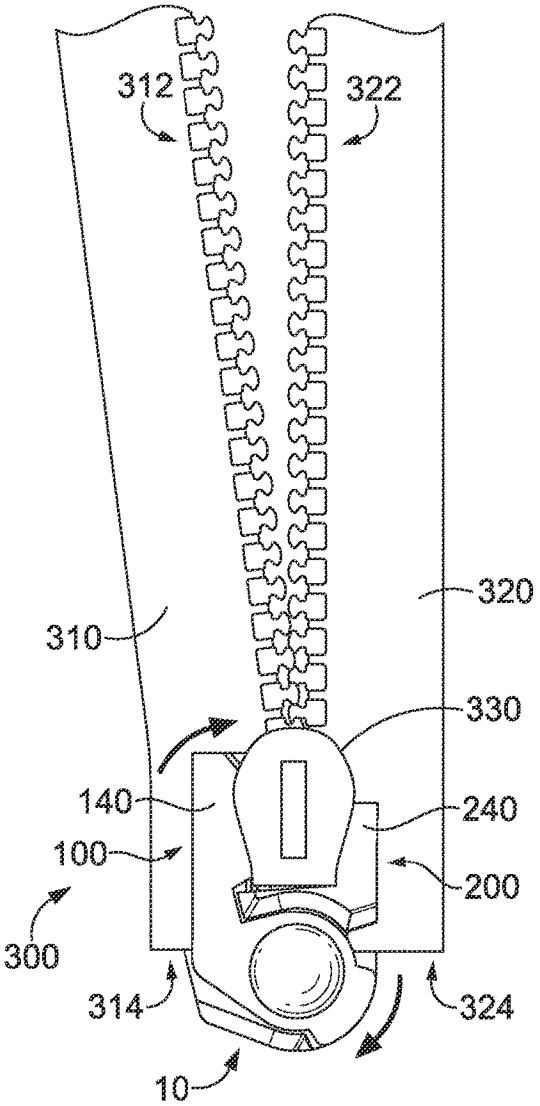
FIG. 6B illustrates a front view of the slide fastener assembly of FIG. 6A and depicts the releasable coupling device in the second position in accordance with aspects herein.
Figure 6A:
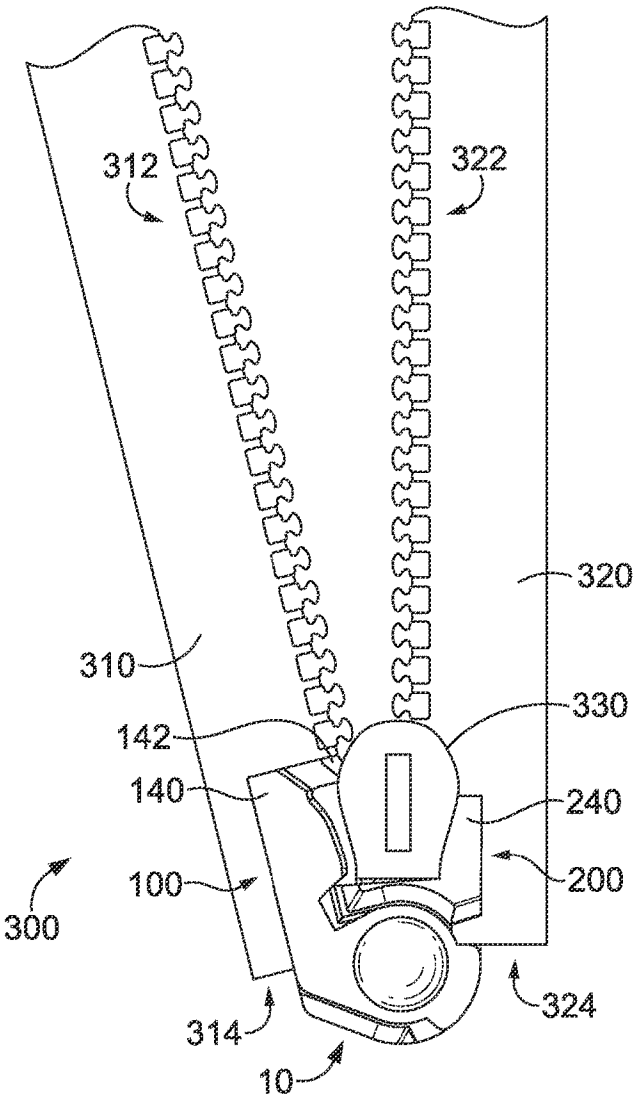
FIG. 6A illustrates a front view of an example slide fastener assembly having the releasable coupling device of FIG. 1A, a first slider tape, and a second slider tape, and depicts the releasable coupling device in the first position in accordance with aspects herein.

FIGS. 6A-6C illustrate an example slide fastener assembly 300, which includes the releasable coupling device 10. As shown, the slide fastener assembly 300 also includes a first slider tape 310, a second slider tape 320, and a slide fastener 330. The first slider tape 310 includes a first set of coupling elements 312, has a first end 314, and is configured to secure to an underlying object, such as a textile or a fabric panel. Likewise, the second slider tape 320 includes a second set of coupling elements 322, has a second end 324, and is configured to secure to an underlying object. In example aspects, the slide fastener 330 is permanently mounted to the second slider tape 320 and is configured to couple and decouple the first and second sets of coupling elements 312, 322 when traversing the first and second sets of coupling elements 312, 322. The first housing structure 100 is attached to the first slider tape 310 at the first end 314 via the first extension member 140. Likewise, the second housing structure 200 is attached to the second slider tape 320 at the second end 324 via the second extension member 240. In an example aspect, the first and second housing structures 100, 200 may be respectively attached to the first and second slider tapes 310, 320 using an adhesive. Another example aspect contemplates that the first and second housing structures 100, 200 may be respectively molded (e.g., injection molding) directly onto the first and second slider tapes 310, 320.

In FIGS. 6A-6C, the first and second slider tapes 310, 320 are depicted as zipper tapes, the first and second sets of coupling elements 312, 322 are depicted as sets of zipper teeth, and the slide fastener 330 is depicted as a zipper. Other slider systems are contemplated herein. Moreover, the first extension member 140 is depicted as including the zipper tooth 142, which, in this example, is configured to couple with the second set of coupling elements 322. Moreover, each of FIGS. 6A-6C depict the slide fastener assembly 300 at a different stage of releasable fastening, and the arrows in FIGS. 6B and 6A indicate directional movement of the releasable coupling device 10 and the slide fastener 330.

FIG. 6A depicts the releasable coupling device 10 in the first coupled state 11 (not identified), depicts the slide fastener 330 as proximate the first and second ends 314, 324 of the first and second slider tapes 310, 320, and depicts the first and second sets of coupling elements 312, 322 as uncoupled. Moreover, the first slider tape 310 extends away from the releasable coupling device 10 in a direction that is similar to or parallel to the first direction (i.e., a direction that the first extension member 140 extends from the encircling structure 120), and the second slider tape 320 extends away from the releasable coupling device 10 in a direction that is similar to or parallel to the second direction (i.e., a direction that the second extension member 240 extends from the receiving receptacle 220). Thus, the first and second slider tapes 310, 320 are proximate one another at the first and second ends 314, 324, and are spaced farther apart from one another as they extend away from the releasable coupling device 10.

FIG. 6B depicts the releasable coupling device 10 in the second coupled state 12 (not identified) and after being moved in a clockwise direction. The slide fastener 330 is again depicted proximate the first and second ends 314, 324 of the first and second slider tapes 310, 320, and the first and second sets of coupling elements 312, 322 are depicted as uncoupled. Additionally, the first and second slider tapes 310, 320 extend in a direction that is similar to or parallel to the first and second directions, respectively. Thus, the first and second slider tapes 310, 320 are adjacent one another at the first and second ends 314, 324 and are spaced proximate one another as they extend away from the releasable coupling device 10. When the releasable coupling device 10 is in the second coupled state 12 (not identified), the slide fastener 330 may be removable secured to the first housing structure 100 by, for instance, the first extension member 140 being removably positioned within a slot in a throat of the slide fastener 330.

FIG. 6C depicts the slide fastener 330 after being moved in a direction away from the first and second ends 314, 324 at a midway position on the first and second slider tapes 310, 320. The releasable coupling device 10 is depicted in the second coupled state 12 (not identified), and the first and second sets of coupling elements 312, 322 are depicted as partially coupled. As such, coupling elements of the first and second sets of coupling elements 312, 322 are uncoupled above the slide fastener 330 and coupled below the slide fastener 330. Also, the zipper tooth 142 is coupled with coupling elements of the second set of coupling elements 322.

Figure 7A:
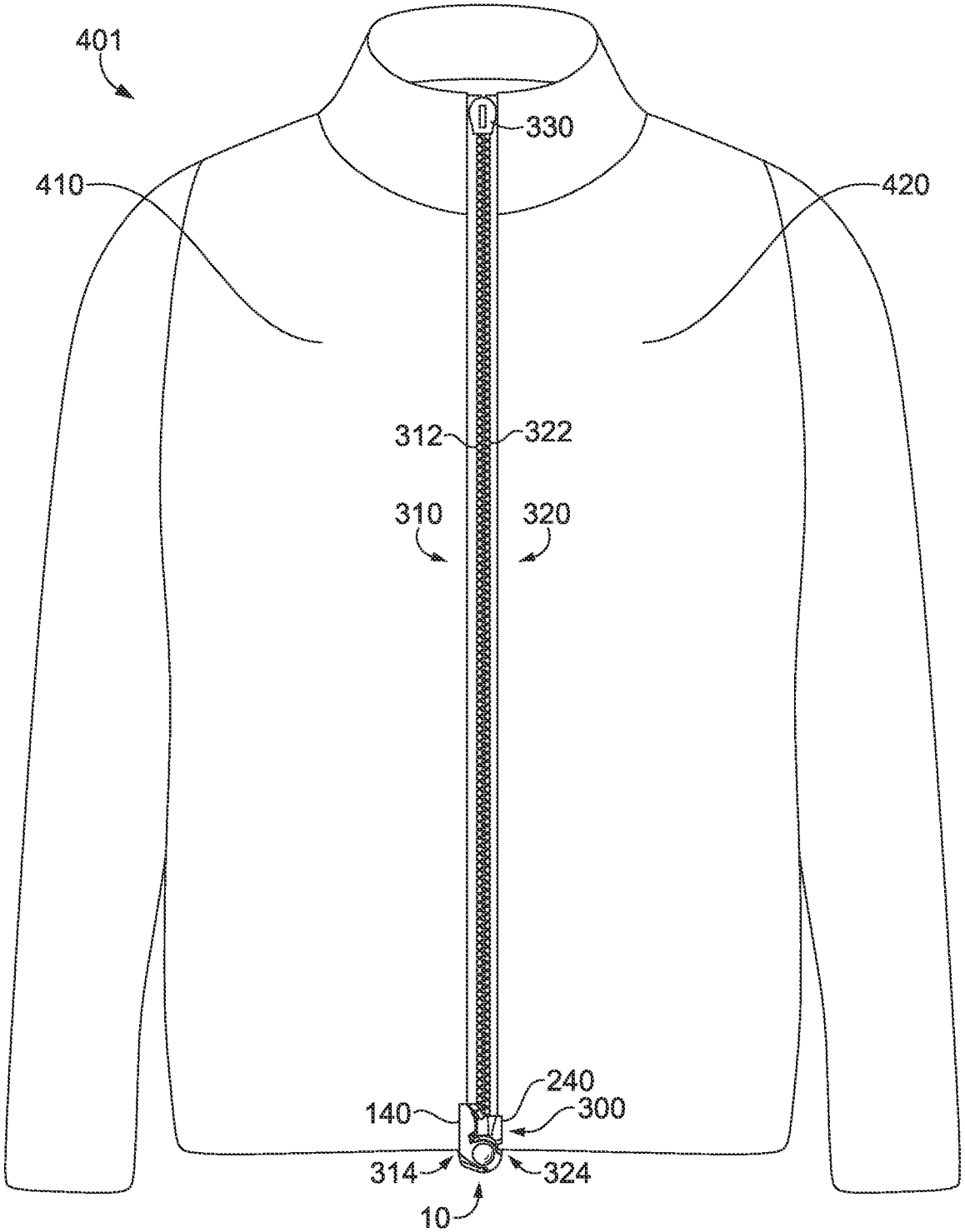
FIG. 7A illustrates a front view of an example upper body garment having the slide fastener assembly of FIG. 6A in accordance with aspects herein.

FIG. 7A is a front view of an example upper body garment 401 incorporating the slide fastener assembly 300. In this example, the upper body garment 401 is a jacket, and the slide fastener assembly 300 is used to releasably fasten a first fabric panel 410 and a second fabric panel 420 at a center front of the upper body garment 401. As shown, the first slider tape 310 is joined with the first fabric panel 410, and the second slider tape 320 is joined with the second fabric panel 420. Moreover, the slide fastener 330 is mounted to the first and second sets of coupling elements 312, 322 of the first and second slider tapes 310, 320, which are engaged with one another below the slide fastener 330. Further, the releasable coupling device 10 is attached to the first slider tape 310 at the first end 314 via the first extension member 140 and is also attached to the second slider tape 320 at the second end 324 via the second extension member 240.

Figure 7B:
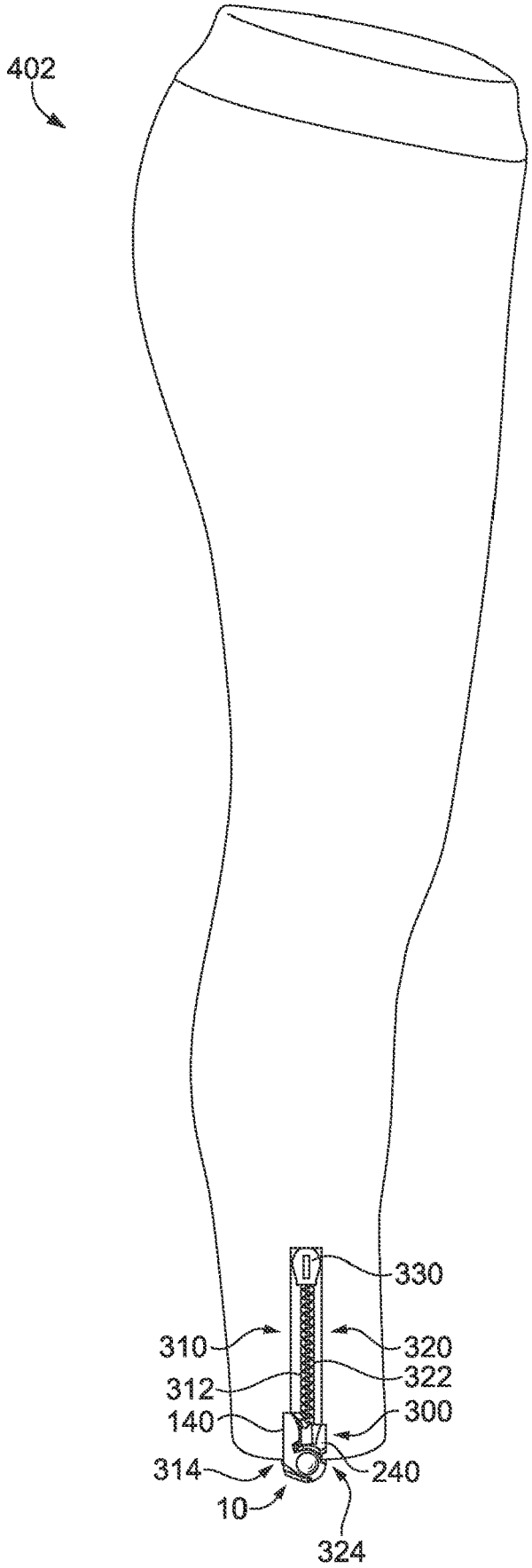
FIG. 7B illustrates a side view of an example lower body garment having the slide fastener assembly of FIG. 6A in accordance with aspects herein.

FIG. 7B is a front view of an example lower body garment 402 incorporating the slide fastener assembly 300. In this example, the lower body garment 402 is a pant, and the slide fastener assembly 300 is used to releasably fasten a first portion at a bottom of a pant leg and a second portion at the bottom of the pant leg to widen or narrow an opening of the pant leg. As shown, the first slider tape 310 is joined with the first fabric panel 410, and the second slider tape 320 is joined with the second fabric panel 420. Moreover, the slide fastener 330 is mounted to the first and second sets of coupling elements 312, 322 of the first and second slider tapes 310, 320. Further, the releasable coupling device 10 is attached to the first slider tape 310 at the first end 314 via the first extension member 140 and is also attached to the second slider tape 320 at the second end 324 via the second extension member 240.

Figure 8:
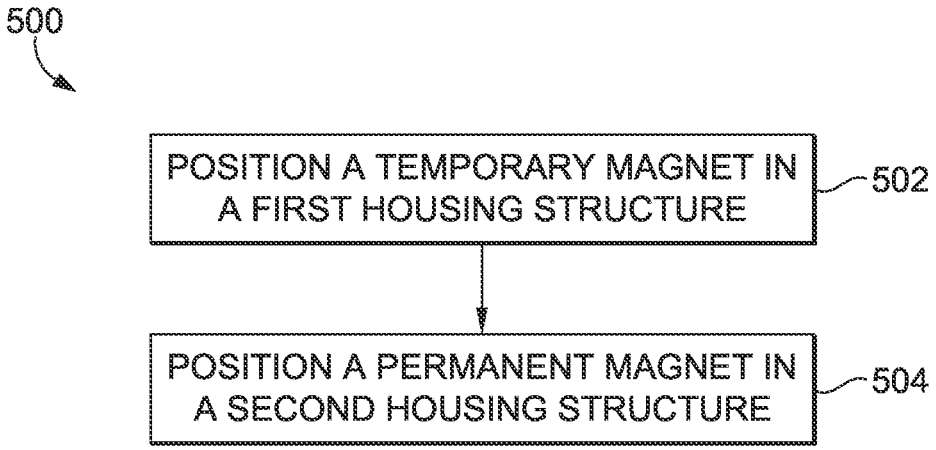
FIG. 8 illustrates a flow diagram of an example method of manufacturing the releasable coupling device of FIG. 1A in accordance with aspects herein.

FIG. 8 illustrates a flow diagram of an example method 500 of manufacturing the releasable coupling device 10. As shown, at block 502, a first step of the method is depicted, which includes positioning a temporary magnet, such as the temporary magnet 110 in a first housing structure, such as the first housing structure 100. In aspects, the temporary magnet has a spherical shape and the first housing structure includes an encircling structure, such as the encircling structure 120 that encircles a portion of the temporary magnet such that a first surface of the temporary magnet is exposed. At block 504, a second step of the method is depicted, which includes positioning a permanent magnet, such as the permanent magnet 210 in a second housing structure, such as the second housing structure 200. In aspects, the second housing structure includes a receiving receptacle, such as the receiving receptacle 220 adapted to receive the first housing structure such that the permanent magnet is in near contact with the first surface of the temporary magnet.

In further aspects, the first housing structure may include a flange, such as the flange 130 extending from the encircling structure, and the second housing structure may include a notch, such as the notch 230 that is adapted to receive the flange of the first housing structure. Moreover, the first housing structure further comprises a first extension member, such as the first extension member 140 extending in a first direction away from the encircling structure, and the second housing structure further comprises a second extension member, such as the second extension member 240 extending in the first direction away from the receiving receptacle.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described.

What is claimed is:

1. A releasable coupling device for a slide fastener assembly, the releasable coupling device comprising:

a first housing structure comprising a temporary magnet having a spherical shape, the first housing structure including an encircling structure that encircles a portion of the temporary magnet such that a first surface of the temporary magnet is exposed, wherein the first housing structure further comprises a flange extending from the encircling structure, the flange having at least one edge that is concentric with the encircling structure; and a second housing structure comprising a permanent magnet, the second housing structure including a receiving receptacle adapted to receive the first housing structure such that the permanent magnet is in near contact with the first surface of the temporary magnet, and wherein the second housing structure comprises a notch that is adapted to receive the flange of the first housing structure.

2. The releasable coupling device of claim 1, wherein the temporary magnet if formed of a material that includes at least one of iron, steel, carbon, aluminum, nickel, cobalt, manganese, or silicon.

3. The releasable coupling device of claim 1, wherein, when the first housing structure and the second housing structure are within a coupling distance, the temporary magnet and the permanent magnet are magnetically attracted.

4. The releasable coupling device of claim 3, wherein, when the first housing structure and the second housing structure are separated by a distance that is greater than the coupling distance, the temporary magnet and the permanent magnet are not magnetically attracted.

5. The releasable coupling device of claim 4, wherein the coupling distance is from about 2.5 cm to about 3.5 .

6. The releasable coupling device of claim 1, wherein the permanent magnet includes a planar first surface, and wherein a portion of the planar first surface is exposed in the second housing structure.

7. The releasable coupling device of claim 6, wherein, when the first housing structure is received by the receiving receptacle of the second housing structure, the exposed portion of the planar first surface of the permanent magnet is in near contact with the first surface of the temporary magnet.

8. The releasable coupling device of claim 6, wherein the permanent magnet includes a planar second surface that is positioned opposite the planar first surface, and wherein at least a portion of the planar second surface is exposed in the second housing structure.

9. The releasable coupling device of claim 8, wherein the exposed portion of the planar second surface of the permanent magnet has a greater surface area than the exposed portion of the planar first surface of the permanent magnet.

* * * * *